US012420141B2

(12) United States Patent
Shahid

(10) Patent No.: US 12,420,141 B2
(45) Date of Patent: Sep. 23, 2025

(54) PORTABLE HANGBOARD FOR GRIP AND FINGER STRENGTH TRAINING

(71) Applicant: Muhammad Taimour Shahid, Brampton (CA)

(72) Inventor: Muhammad Taimour Shahid, Brampton (CA)

(73) Assignee: Muhammad Taimour Shahid

( * ) Notice: Subject to any disclaimer, the term of this patent is extended or adjusted under 35 U.S.C. 154(b) by 135 days.

(21) Appl. No.: 18/492,011

(22) Filed: Oct. 23, 2023

(65) Prior Publication Data

US 2025/0128121 A1 Apr. 24, 2025

(51) Int. Cl.
*A63B 23/16* (2006.01)
*A63B 21/00* (2006.01)

(52) U.S. Cl.
CPC ..... *A63B 23/16* (2013.01); *A63B 21/4035* (2015.10); *A63B 2208/029* (2013.01); *A63B 2209/18* (2020.08)

(58) Field of Classification Search
CPC . A63B 21/4035; A63B 21/4039; A63B 23/16; A63B 2208/0285; A63B 2208/029; A63B 2209/18
See application file for complete search history.

(56) References Cited

U.S. PATENT DOCUMENTS 5,242,352 A * 9/1993 Elliott ..... A63B 23/1209 482/111
7,963,891 B1 * 6/2011 Zeaman ..... A63B 21/4035 482/106
8,764,613 B1 * 7/2014 Barnes ..... A61H 39/04 482/44
8,852,058 B1 * 10/2014 Hamberis ..... A63F 9/24 482/44
10,086,225 B2 * 10/2018 Sheppard ..... A63B 21/0728
D845,407 S * 4/2019 Sorin ..... D21/694
11,173,338 B1 * 11/2021 Johnson ..... A63B 21/1645
D965,712 S * 10/2022 Myer ..... D21/694
11,951,349 B1 * 4/2024 Spencer ..... A63B 21/0724
2004/0248712 A1 * 12/2004 Svihra ..... A63B 21/4045 482/93
2005/0233879 A1 * 10/2005 Harrington ..... A63B 21/00185 482/148

(Continued)

FOREIGN PATENT DOCUMENTS

JP 2024054798 A * 4/2024
KR 102597813 B1 * 11/2023

*Primary Examiner* — Gary D Urbiel Goldner

(57) ABSTRACT

A novel portable grip and finger strength training hangboard device allows a user to perform weightlifting exercises, with a focus on grip strength training. The device is unique as it eliminates a user of intermediary items such as ropes, or bolts for latching onto a source of resistance. The source of resistance is gym equipment comprising dumbbells, barbells, and pullup bars. The device has two main components: a gripping mechanism and a built-in hook anchor. The user interacts with the gripping mechanism and adjusts their hands to the desired grip, such as a pinch grip or a crimp grip. The gripping mechanism of the device has varying embodiments and features comprising grooves, loops and ridges. The built-in hook anchor of the device quickly latches on to the source of resistance and allows the user to easily change resistance from one workout to next.

4 Claims, 10 Drawing Sheets

(56) References Cited

U.S. PATENT DOCUMENTS

| | | | | |
|---|---|---|---|---|
| 2009/0203508 | A1* | 8/2009 | Hauser | A63B 21/4049 482/139 |
| 2011/0173778 | A1* | 7/2011 | Wales | B25G 3/20 16/426 |
| 2012/0184415 | A1* | 7/2012 | Rothacker | A63B 23/16 482/93 |
| 2012/0329610 | A1* | 12/2012 | White | A63B 21/4035 482/44 |
| 2018/0056110 | A1* | 3/2018 | Prince | A63B 21/4033 |
| 2018/0126218 | A1* | 5/2018 | Curry | A63B 21/0552 |
| 2019/0105528 | A1* | 4/2019 | Bardakci | A63B 23/14 |
| 2019/0247714 | A1* | 8/2019 | Curry | A63B 21/068 |
| 2019/0351281 | A1* | 11/2019 | Monarrez, Jr. | A63B 21/4035 |
| 2021/0205657 | A1* | 7/2021 | Lewis, Jr. | A63B 23/16 |
| 2023/0124753 | A1* | 4/2023 | Karpachevskyy | A63B 21/4035 482/44 |
| 2023/0302323 | A1* | 9/2023 | Sasano | A63B 21/4035 |

* cited by examiner

PORTABLE HANGBOARD FOR GRIP AND FINGER STRENGTH TRAINING

FIELD

The current invention relates to athletic equipment; particularly relating to equipment for portable grip and finger strength training hangboards. Likely classifications are 482/126, 482/123, 482/121, 482/108, 482/49, 482/37.

BACKGROUND OF THE INVENTION

Grip and finger strength training is important for activities like rock climbing. This necessitates the need for an apparatus that can be used for grip strength training with readily available gym equipment. Although equipment for such workouts exists, no options are available which can easily switch the source of resistance, or allow a user to move from one workout to next without first unlatching intermediary items such as a rope or bolt. Furthermore, the intermediary items add length to the apparatus and make it difficult to perform exercise that require a full range of motion, such as deadlifts or lunges.

The existing equipment for portable grip strength training utilized ropes, bolts, carabiners, or other intermediary attachments that connect the gripping mechanism to a source of resistance. Examples of portable grip strength training hangboards include U.S. Pat. No 20230124753A1 and US20120329610A1.

Having an intermediary item such as rope or bolt between the source of resistance and the gripping mechanism adds further challenges to exercises. These challenges include a decreased range of motion, unwanted motion/swing caused from the rope or bolt, increased distance between the gripping mechanism and the source of resistance-thus effecting the centre of mass, and a complicated process of changing the source of resistance when using an apparatus with bolts or ropes.

The apparatus of this disclosure over comes these challenges by incorporating the gripping mechanism and the built-in hook mechanism in a single block of wood.

SUMMARY

The apparatus of present disclosure incorporates a built-in hook and a gripping mechanism; both in a single body, as shown in FIG. 1. The hook is used to latch on to the source of resistance while the user interacts with the gripping mechanism, adjusting the grip to the desired mode of strength training for hands.

The hook mechanism of the apparatus can readily latch onto gym equipment, such as dumbbells, and can easily resistance. For example, a user can simply change resistance by sliding the hook off a 10 lb dumbbell and latch on to a 25 lb dumbbell for the next workout. The hook can also latch on to other gym equipment, comprising barbells, pullup bars and kettlebells.

The gripping mechanism varies in its embodiment; comprising shapes such as a sphere, rectangle or a rod. FIG. 1 shows an embodiment with rectangular shape. Different embodiments of the gripping mechanism allow a user to train different grips. FIG. 9 shows a rod-shaped gripping mechanism and FIG. 10 shows a spherical gripping mechanism. Further to the shapes, gripping mechanism also comprise of grooves and ridges which allow users to train for crimping workouts. FIG. 1 has an example of the groove, depicted as 102.

The apparatus of this disclosure is carved from wood for a natural wood finish; ideal for hand grip training. A solid block of hardwood may be used for carving the apparatus. A combination of plywood and hardwood may also be used for construction the apparatus. The hardwood and plywood get glued together, with the hardwood on the exterior surface for a smooth finish. Once the glue has dried, the apparatus is carved from the block of wood. Carving of the apparatus may be performed with hand tools or power tools based on production scale.

BRIEF DESCRIPTION OF DRAWINGS

The accompanying drawings are an illustration of the invention and serve to explain the principles of the invention. The drawings for not necessarily to scale and are not to be considered limiting to of the scope of invention.

FIG. 1. Shows an isometric view of the first embodiment of the invention.

FIG. 2. Shows the front view of the first embodiment of the invention.

FIG. 3. Shows side view of the first embodiment of the invention.

FIG. 4. Shows back view of the first embodiment of the invention.

FIG. 5. Shows top view of the first embodiment of the invention.

FIG. 6. Shows a user holding the gripping mechanism (with a pinch grip); a Dumbbell is anchored on the hook for resistance.

FIG. 7. Shows a user holding two gripping mechanisms with a crimp grip; the hooks are latched on to a pullup bar.

FIG. 8. Shows a user holding two gripping mechanisms with a crimp grip; the hooks of the apparatuses are latched onto a barbell for resistance as the user prepares to perform a deadlift exercise.

DESCRIPTION OF EMBODIMENTS

FIGS. 1 to 5 show embodiment one of the invention from different angles. The embodiment consists of the main body (100), gripping mechanism (101), groove cut out for crimp gripping (102), and a carved out hook apparatus (103) for latching on the source of resistance.

Figure 1:
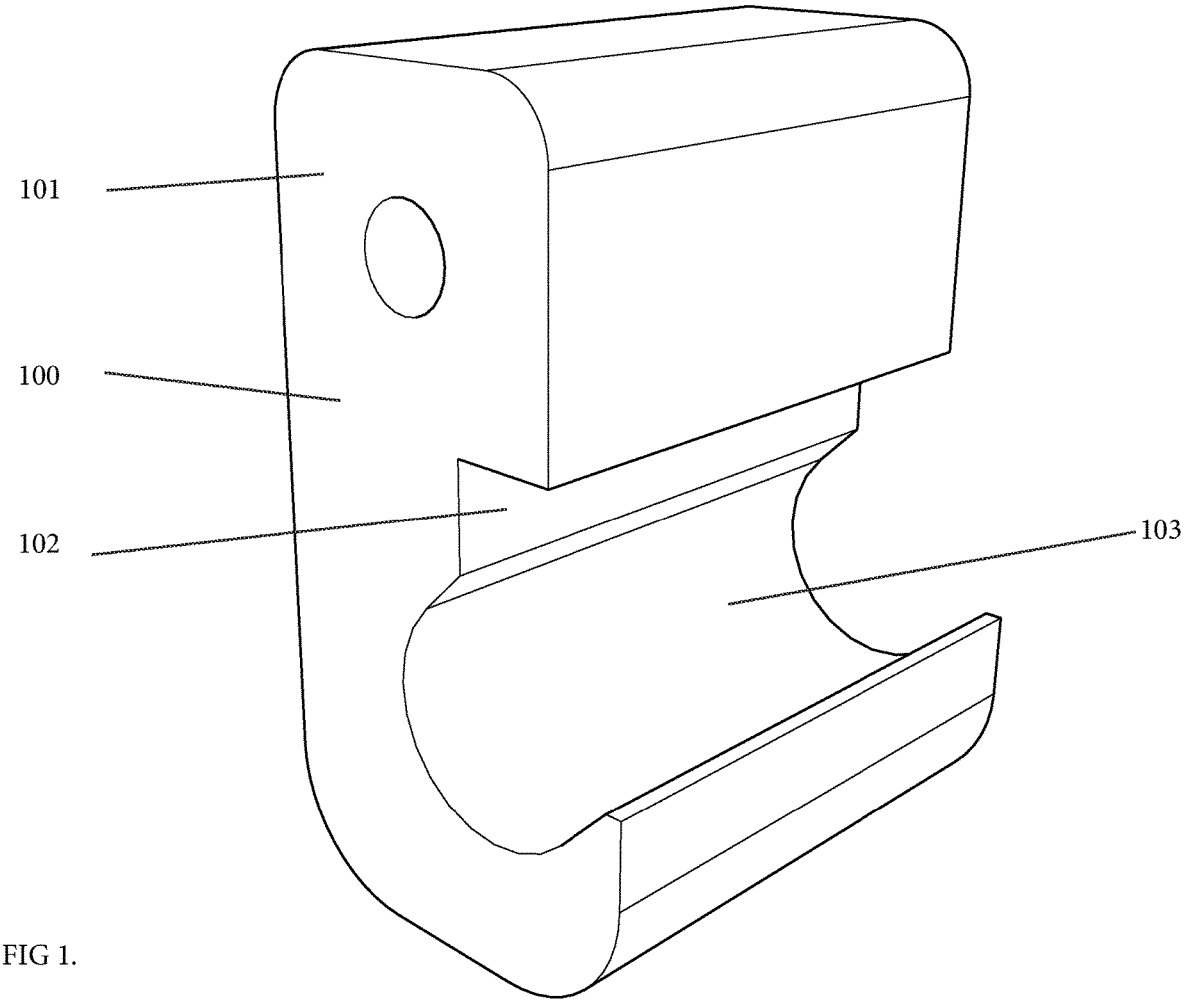
FIG. 1 to FIG. 8: Show the first Embodiment.
Figure 2:
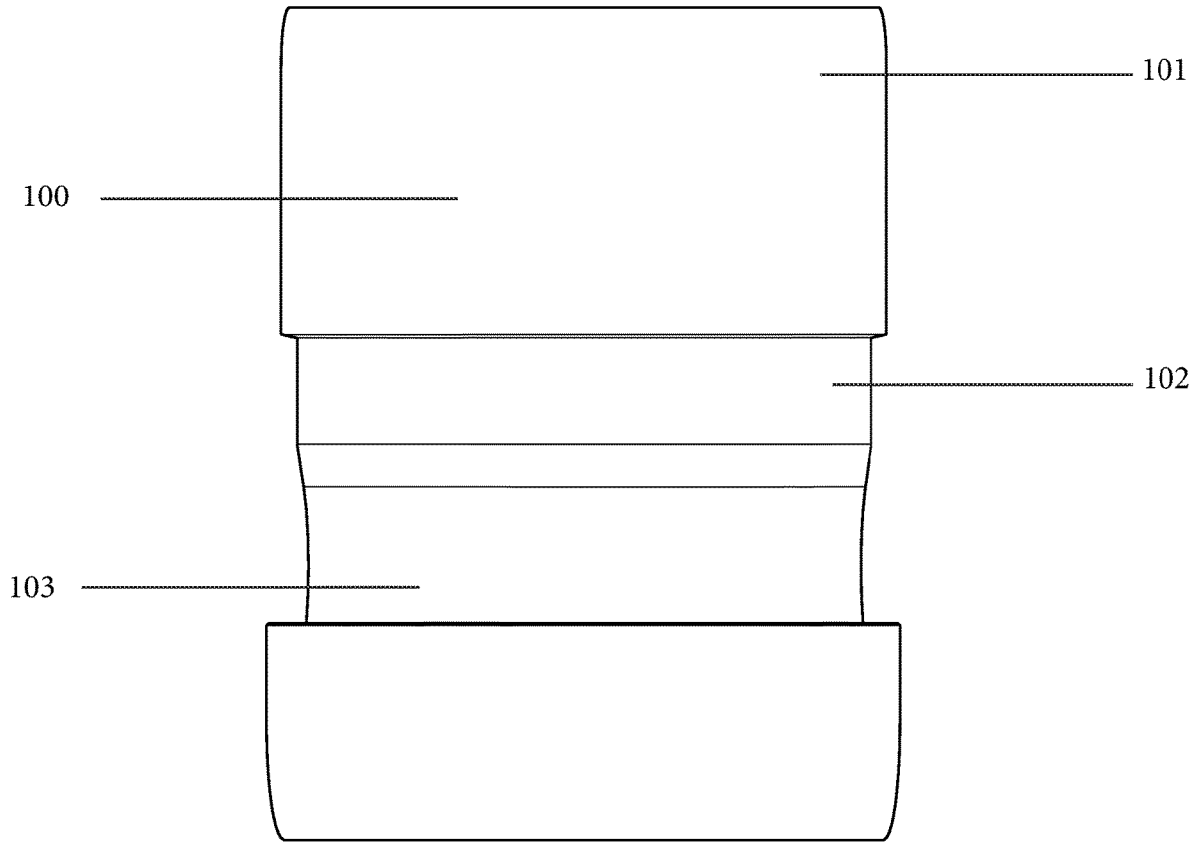
Figure 3:
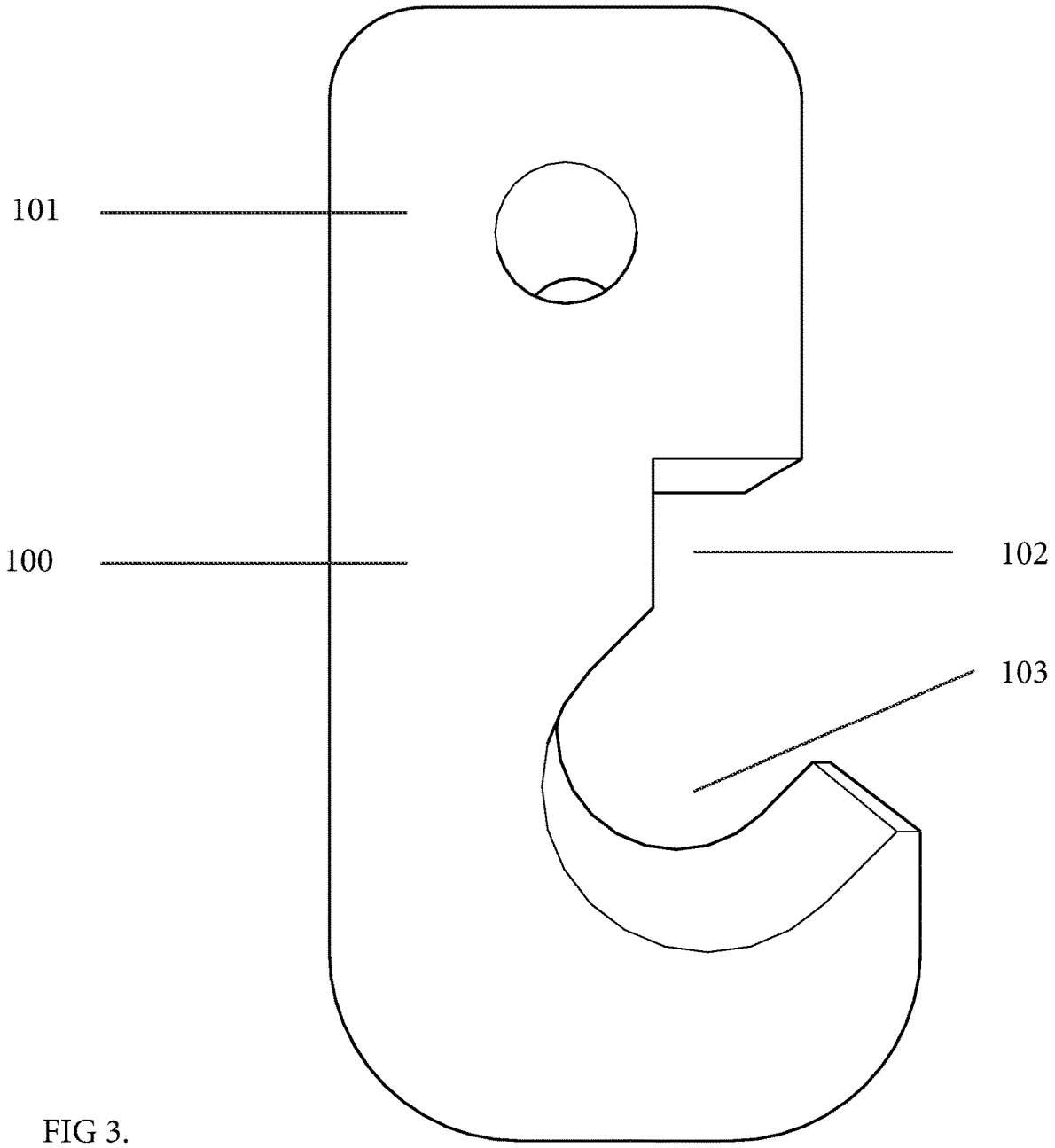
Figure 4:
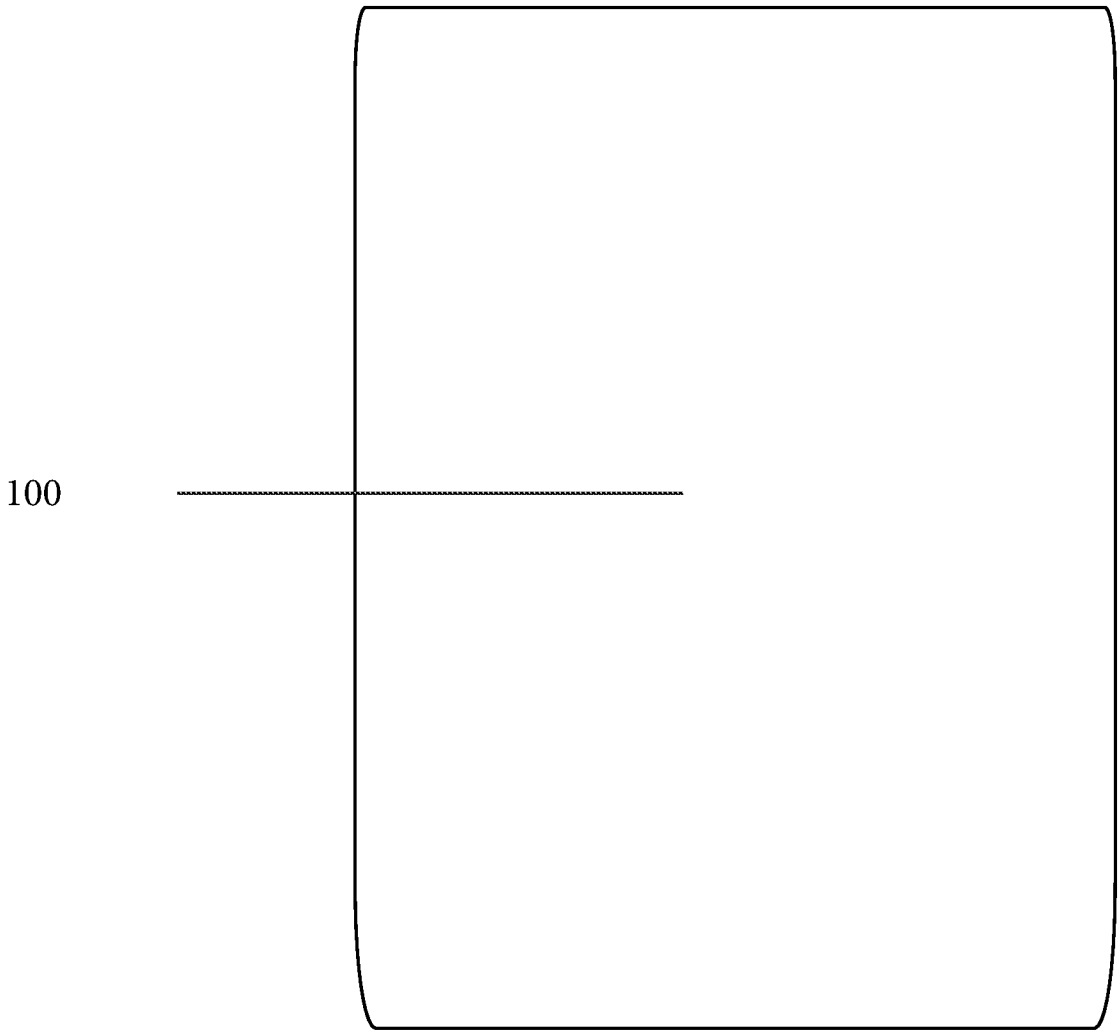
Figure 5:
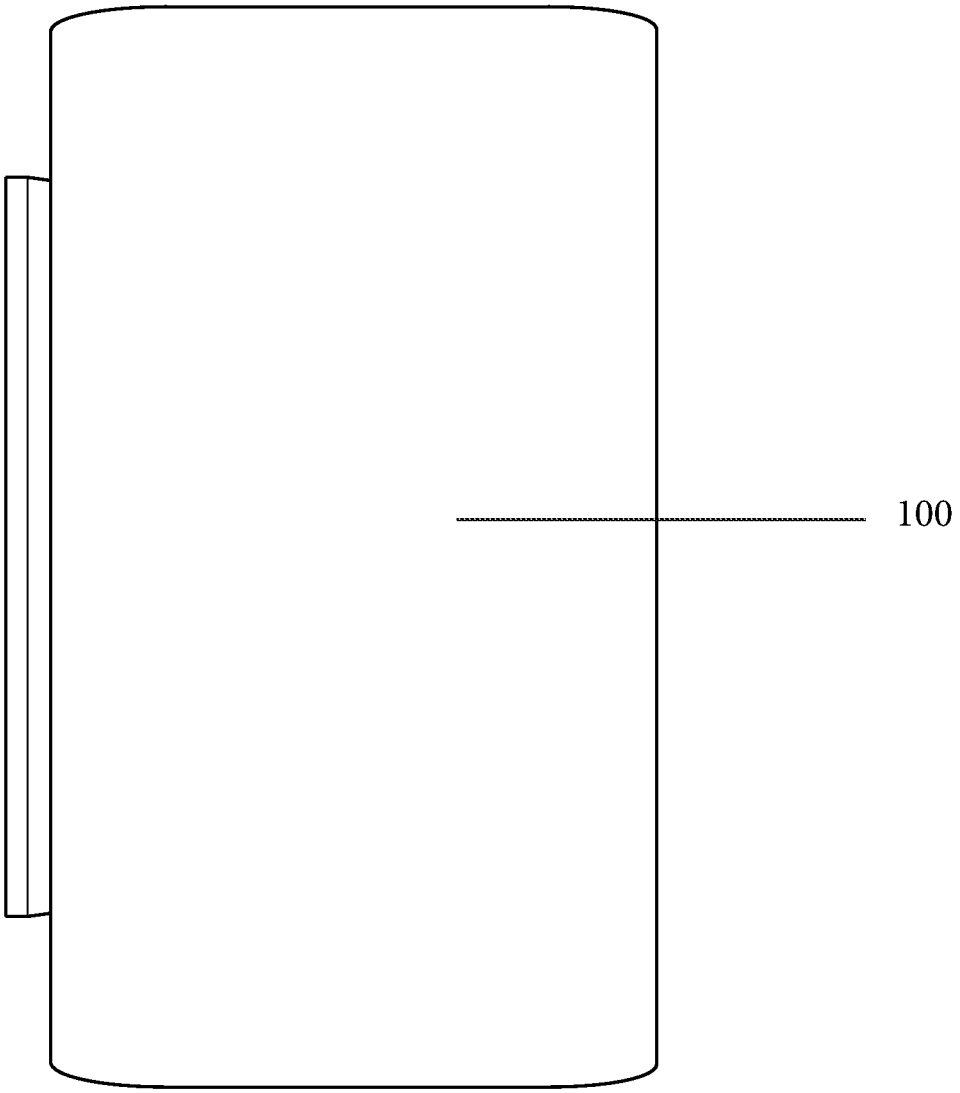
Figure 6:
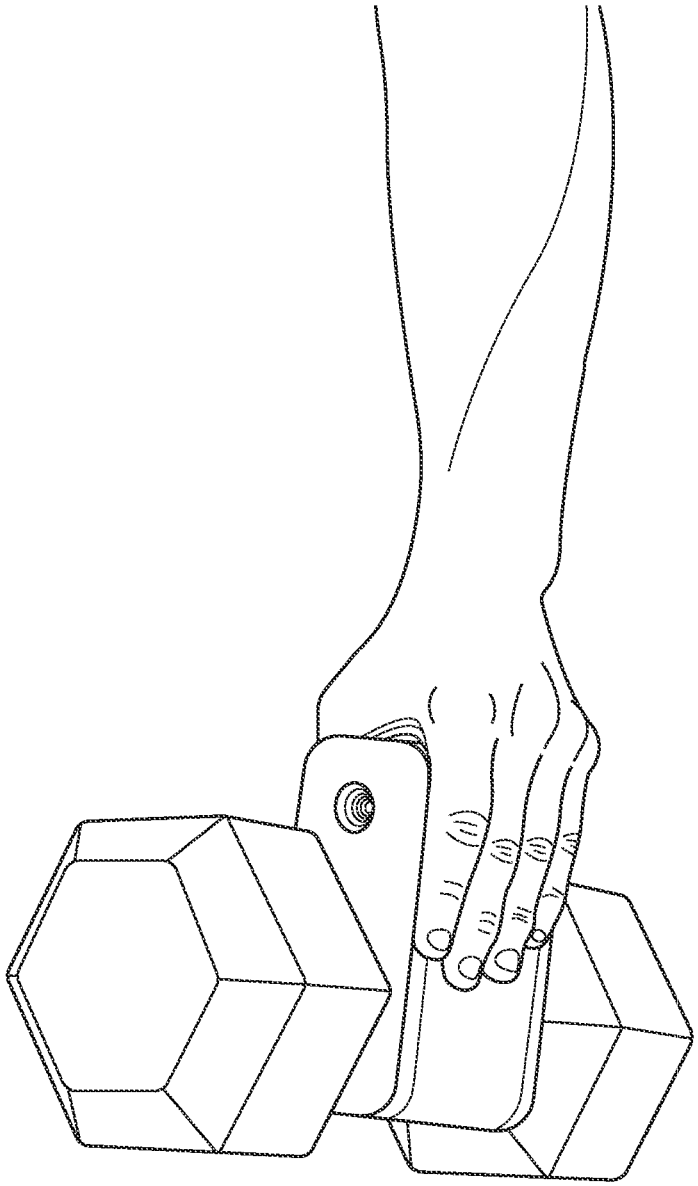
Figure 7:
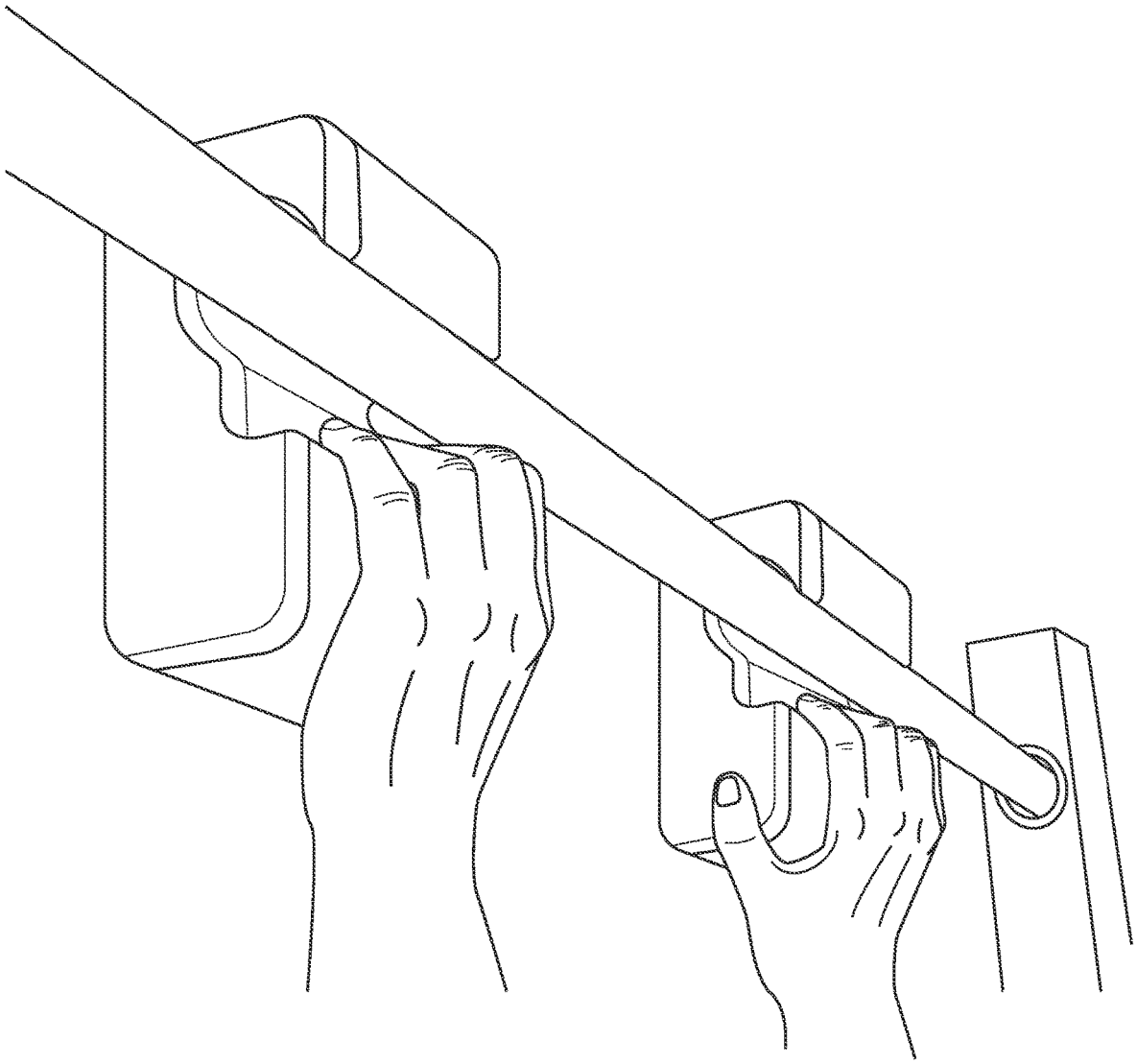
Figure 8:
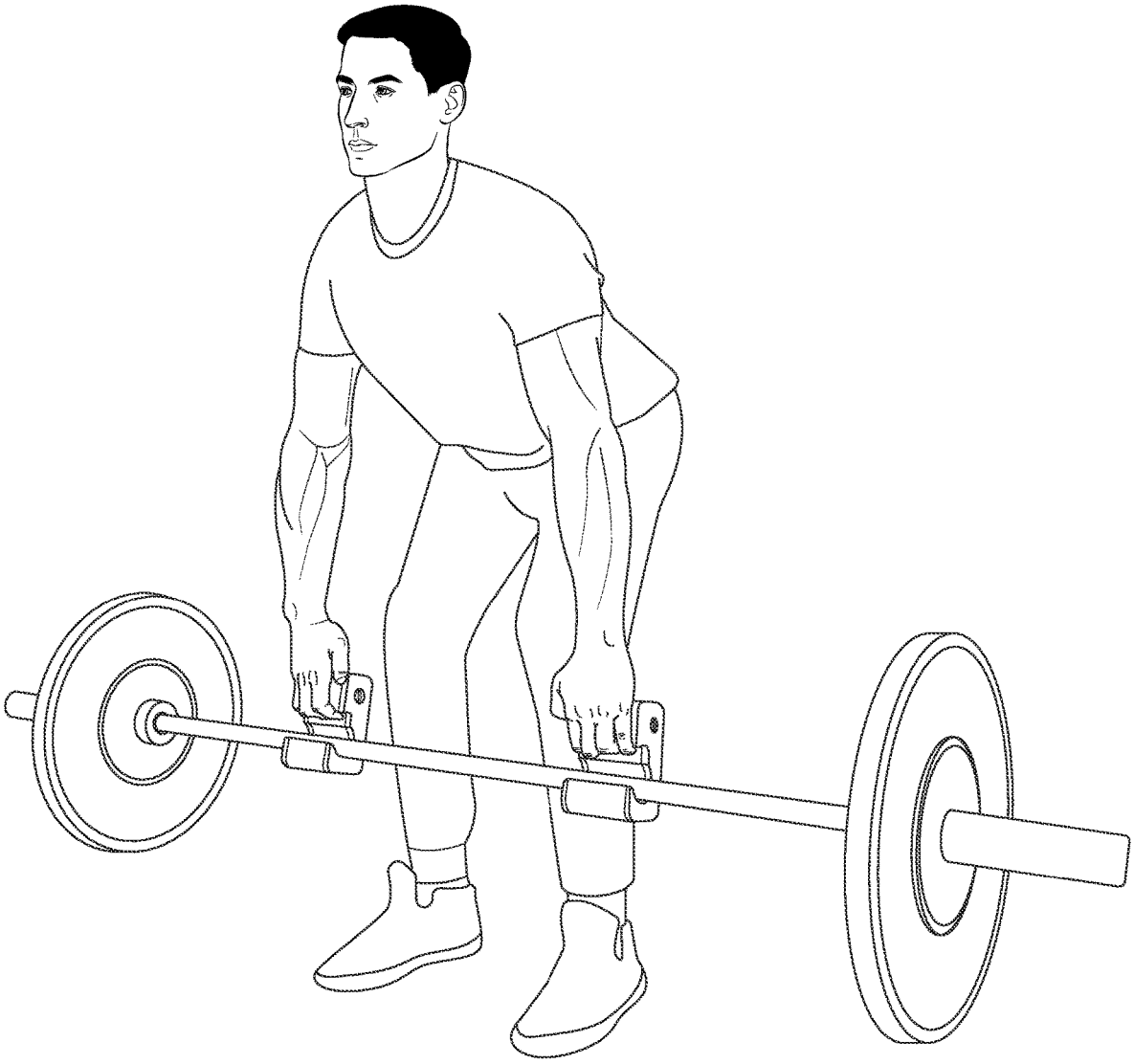

FIGS. 6 to 8 illustrate embodiment one of the invention being used in different workouts. FIG. 6 illustrates a user holding the invention with a pinch grip while a dumbbell is anchored to the hook for resistance. FIG. 7 illustrates a user performing pullups by holding two apparatuses with a crimp grip as the hooks are latched on to a pullup bar. FIG. 8 illustrates a user holding two apparatuses with a crimp grip while preparing to perform a deadlift; the hooks of the two apparatuses are anchored onto a barbell for resistance.

Figure 9:
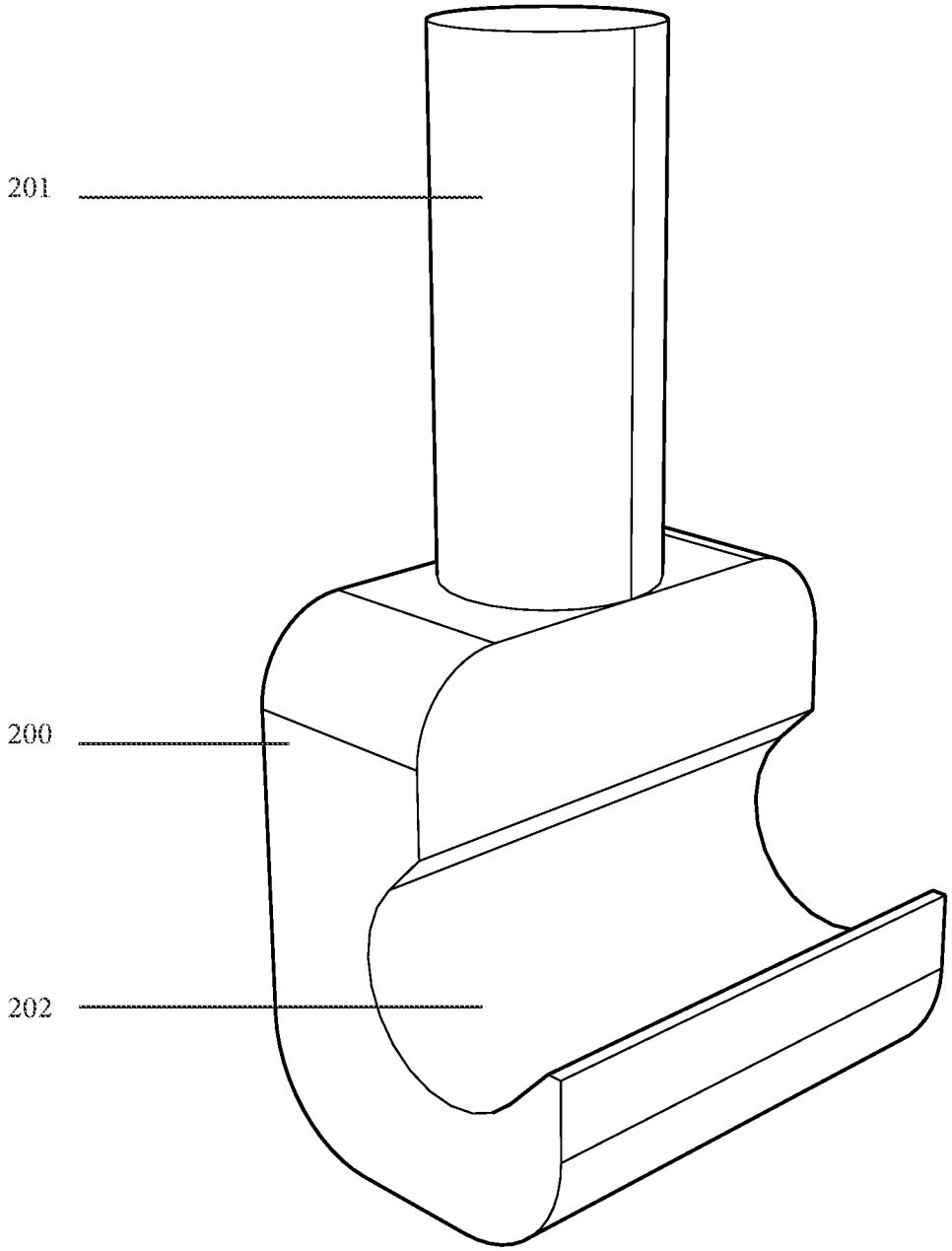
FIG. 9. Shows an alternative embodiment of the apparatus with a rod-shaped gripping mechanism.
Figure 10:
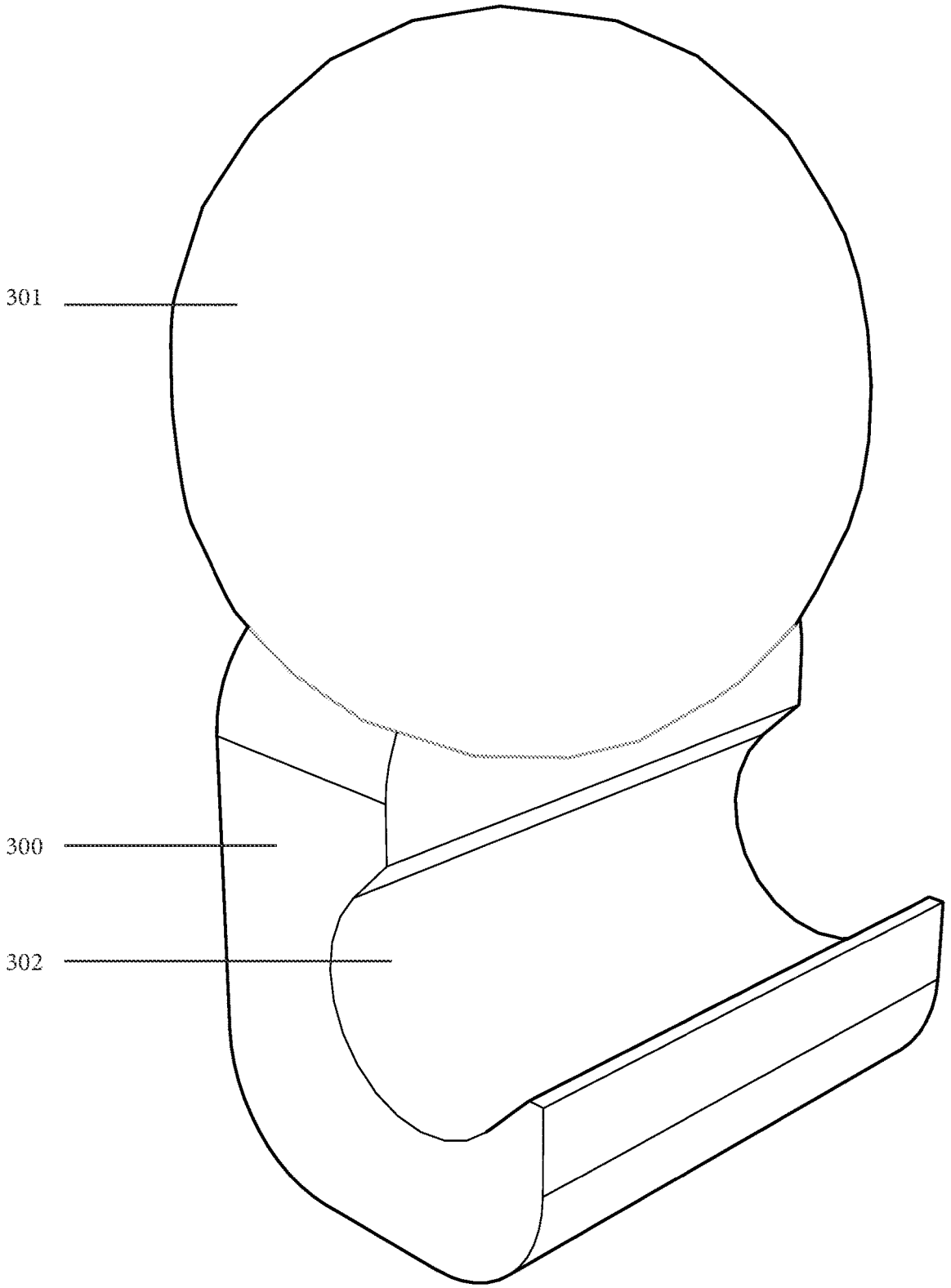
FIG. 10. Shows an alternative embodiment of the apparatus with a spherical gripping mechanism.

FIGS. 9 and 10 show alternative embodiments of the invention, where the gripping mechanism is a rod and spherical respectively.

I claim:

1. A portable hangboard device configured for grip and finger strength training, the portable hangboard device comprising:

a built-in hook anchor configured for latching onto a source of resistance; and a gripping mechanism;

wherein the built-in hook anchor and the gripping mechanism are incorporated into a single block of wood.

2. The portable hangboard device of claim 1, wherein the source of resistance is configured to comprise gym equipment from a group including dumbbells, kettlebells, Olympic barbells, pullup bars, and lat pulldown bars.

3. The portable hangboard device of claim 1, wherein the gripping mechanism comprises a shape from a group including spheres, loops, circles, and rectangles.

4. The portable hangboard device of claim 1, wherein the gripping mechanism comprises ridges, loops, holes, grooves, and/or indents, and is configured to focus on the grip and finger strength training comprising a pinch grip or a crimp grip.

* * * * *